US008381397B2

(12) United States Patent
Dion et al.

(10) Patent No.: US 8,381,397 B2
(45) Date of Patent: Feb. 26, 2013

(54) METHOD FOR APPLYING A SHIELD TAPE TO INSULATED CONDUCTORS

(75) Inventors: Kirk D. Dion, Center Barnstead, NH (US); Moe J. Jaber, Hubberston, MA (US)

(73) Assignee: General Cable Technologies Corporation, Highland Heights, KY (US)

( * ) Notice: Subject to any disclaimer, the term of this patent is extended or adjusted under 35 U.S.C. 154(b) by 184 days.

(21) Appl. No.: 12/875,014

(22) Filed: Sep. 2, 2010

(65) Prior Publication Data

US 2010/0325880 A1 Dec. 30, 2010

Related U.S. Application Data

(62) Division of application No. 12/354,876, filed on Jan. 16, 2009, now Pat. No. 7,827,678.

(60) Provisional application No. 61/061,037, filed on Jun. 12, 2008.

(51) Int. Cl.
*H01R 43/00* (2006.01)

(52) U.S. Cl. ..... 29/868; 29/872; 29/873

(58) Field of Classification Search ..... 29/868, 29/728, 729, 755, 872, 873; 156/54, 202, 156/428; 174/10, 36, 102 R, 106 R, 107, 174/109, 113 R, 115, 117 F
See application file for complete search history.

(56) References Cited

U.S. PATENT DOCUMENTS

| | | | | |
|---|---|---|---|---|
| 4,041,237 | A * | 8/1977 | Stine et al. | 174/36 |
| 4,100,003 | A | 7/1978 | Trusch | |
| 4,327,246 | A | 4/1982 | Kincaid | |
| 4,574,571 | A | 3/1986 | Thompson | |
| 4,596,897 | A | 6/1986 | Gruhn | |
| 4,737,598 | A * | 4/1988 | O'Connor | 174/36 |
| 4,830,901 | A | 5/1989 | Merry | |
| 4,855,534 | A | 8/1989 | O'Connor | |
| 5,329,064 | A | 7/1994 | Tash et al. | |
| 5,416,268 | A | 5/1995 | Ellis | |
| 5,486,649 | A | 1/1996 | Gareis | |
| 5,956,445 | A | 9/1999 | Deitz, Sr. et al. | |

FOREIGN PATENT DOCUMENTS

| | | | |
|---|---|---|---|
| JP | 11238417 | A | 8/1999 |
| JP | 2002289047 | A | 10/2002 |
| JP | 2004220798 | A | 8/2004 |

* cited by examiner

*Primary Examiner* — Thiem Phan
(74) *Attorney, Agent, or Firm* — Blank Rome LLP

(57) ABSTRACT

A method for applying a shield tape to conductors that comprises folding a first edge of the shield tape in a first direction from a central portion while folding a second edge in a second direction opposite the first direction; applying a fold to the first edge by folding the first edge back over onto the central portion forming a receiving area while wrapping the shield tape around the conductors; tightening the shield tape around the conductors such that the conductive layer of the shield tape is on the outside of insulating layer and facing away from the conductors while positioning the receiving area to receive a drain wire; installing a drain wire in the receiving area; and closing the shield tape around the conductors and the drain wire to form an enclosure around the conductors with the second edge overlapping the fold at an outside surface of the enclosure.

21 Claims, 8 Drawing Sheets

METHOD FOR APPLYING A SHIELD TAPE TO INSULATED CONDUCTORS

CROSS REFERENCE TO RELATED APPLICATIONS

The present application is a divisional application of U.S. Application Ser. No. 12/354,876, filed Jan. 16, 2009 now U.S. Pat. No. 7,827,678, which claims the benefit of U.S. Provisional Application No. 61/061,037, filed Jun. 12, 2008, the entire disclosures of which are hereby incorporated by reference.

FIELD OF THE INVENTION

This invention relates to a device of and method for manufacturing shielded wire and cable. More particularly, the present invention relates to a device of and method for applying longitudinal shield tape to electronic wire and cable using an edge folder to enclose a drain wire in an edge of the shield tape.

BACKGROUND OF THE INVENTION

Modern electronic wire and cable typically includes insulated electrical conductors, such as copper wire, bound together in a common protective jacket or sheath. The conductors are insulated from each other by coating them with an insulating material using an extrusion process, such as pressure extrusion or tube/sleeve extrusion. Under accepted industry standards, individual conductors are allowed to include a predetermined amount of defects or pin-holes in the insulation, which are measured by "spark" tests. Such imperfections are essentially unavoidable during the fabrication of the individual conductors and can result in "hi-pot" (high potential) test failures in cabled conductors if the current traveling through those conductors arcs with shield tape disposed around the conductors.

Shield tape is typically applied around cabled conductors to shield the conductors from the undesired effects of external influences, such as electromagnetic radiation. A variety of different constructions of shield tape have been applied around conductors in a number of different configurations to shield the conductors from such effects. Shield tape constructions generally include thin metallic foil layers, such as aluminum, laminated with a layer of insulating film, such as polyester, that form opposing sides of the shield tape. The layer of insulating film is provided to add strength and durability to the shield tape as well as to insulate the aluminum layer. A non-insulated grounding wire, or "drain" wire, is disposed on the aluminum side of the shield tape in electrical contact therewith to provide a low resistance electrical connection, or drain, to ground from substantially any point along the shield tape.

Shield tape is typically applied either helically wound around the conductors or longitudinally wrapped, i.e., "cigarette" wrapped, around the conductors. In both applications, the longitudinal edges of the shield tape generally must overlap one another by a relatively large amount, such as 25%, to prevent the shield from leaking radiation. The shield tape may be applied around the conductors either with the aluminum side facing outward away from the conductors and the drain wire disposed on the outside of the shield tape between the shield tape and the jacket or with the aluminum side facing inward toward the conductors and the drain wire disposed between the shield tape and the conductors. There are significant problems, however, with those conventional configurations of the shield tape and drain wire.

Shield tape is generally helically wound around the conductors to improve the flexibility of the cable. Helically wound shield tape, however, is prone to loosening and kinking at the overlapping edges when it is flexed during use or when drawn through various types of conduits during installation. Loosening and kinking of the shield tape may create spiral slots around the circumference of the shield that radiate interference rather than inductively coupling interference. The interference may radiate as much as 360° around the shield. Although it is also possible for slots to appear at the overlapping edges in cigarette wrapped shielding, those slots will be longitudinal and will radiate interference less effectively because they radiate interference only in the plane of the longitudinal slot. In addition, helically wound shield tape has a greater tendency to conform to the conductors than cigarette wrapped shield tape and is therefore less geometrically stable and more likely to form slots in the shielding.

Helically wound shield tape may be applied to the conductors during the cabling/stranding of the conductors. When shield tape is helically wound around the conductors during cabling/stranding, the shield tape is drawn over the conductors as the conductors rotate, or twist, together. To allow sufficient overlap of the shield tape edges and to ensure that the shield tape is tightly wound around the conductors, the twist lay length of the conductors must be short. Not only do short lay lengths require slower cabling/stranding speeds, they also require a greater amount of conductor material to make the same length of cable, which in turn results in a larger signal delay through the conductors. To apply helically wound shield tape around conductors with larger lay lengths with sufficient overlap and tightness, additional equipment must be used to rotate the shield tape around the conductors at a slower rate than the conductors are being twisted together. This extra machinery can be cost prohibitive.

Helically wound shield tape may also be applied to the conductors subsequent to the cabling/stranding of the conductors. When shield tape is helically wound around the conductors subsequent to cabling/stranding, the shield tape may be applied with sufficient overlap and tightness around the conductors irrespective of the conductors' lay length. This process, however, requires that the conductors be collected on a reel after cabling/stranding and then paid off that reel into separate machinery that applies the shield tape, which requires additional man hours and multiple staging areas and is overall less efficient and more expensive than applying shield tape during cabling/stranding.

As discussed above, the drain wire may be applied between the shield tape and the jacket or between the shield tape and the conductors for either helically wound or cigarette wrapped conductors, depending on the side of the shield tape that faces the conductors. When the shield tape is applied with the aluminum side facing downward toward the conductors, the drain wire must be disposed between the conductors and the shield tape. To prevent the drain wire and/or shield tape from arcing with defects in the conductors and to prevent the drain wire from damaging the insulation on the conductors, a barrier layer of insulating material is typically applied around the conductors so that the aluminum side of the shield tape is in contact with the barrier layer and the drain wire is disposed therebetween. Applying an additional layer of insulating material around the conductors, however, requires additional material and machinery and greatly adds to the costs of manufacturing the cable.

In view of at least the above-identified problems, it is preferable to manufacture shielded cable by applying shield tape around the conductors in a cigarette wrapped configuration with the aluminum side of the shield tape facing outward away from the conductors. Even this configuration, however, creates several problems. For example, the dies used to fold the shield tape suffer significant wear when the aluminum side of the shield tape faces outward away from the conductors because the aluminum side of the shield tape is thereby placed in frictional contact with the dies as the shield tape moves through the dies. Although those dies are typically coated with a protective material to protect against excessive wear, the shield tape will still wear through the protective material when drawn through the dies at higher speeds. And, although pre-lubricated shield tape may be purchased, such shield tape can be cost prohibitive.

In addition, when the aluminum side of the shield tape faces outward away from the conductors, the drain wire must be disposed on the outside of the shield tape so the drain wire will be in electrical contact with the shield tape. Placing the drain wire outside the shield tape, however, creates a bulge in the otherwise flat surface of shield tape surrounding the conductors. If the cable jacket is pressure extruded over the assembly, the jacket will fill in around the drain wire and cause a groove to form on the inside of the jacket and/or a ridge to form on the outside of the jacket. And, if the jacket is tube/sleeve extruded over the assembly, the cable jacket will stretch around the drain wire and cause a ridge to form on the outside of the jacket. A groove on the inside of the jacket compromises the integrity of the cable by creating a thinner portion of jacket extending the length of the jacket, and a ridge on the outside of the jacket will compromise the integrity of the cable by not only adversely affecting the aesthetics of the cable, but also by making it more difficult to draw the cable through various types of conduits during installation.

Accordingly, there is a need for a device of and method for manufacturing shielded cable that allows the conductors to be shielded in a cigarette wrapped configuration, allows the drain wire to be on the outside of the shield tape without forming a ridge, and minimizes the amount of leakage in the shield. Further, there is a need to manufacture such a cable without causing excessive wear to the folding dies and while reducing the amount of additional cable material, man hours, work space and machinery required to shield the cable.

SUMMARY OF THE INVENTION

Accordingly, to solve at least the above problems and/or disadvantages and to provide at least the advantages described below, a non-limiting object of the present invention is to provide a shielded cable and device of and method for making same that includes a first folding die configured to fold a first edge of a shield tape a first direction from a central portion of the shield tape and to fold a second edge of the shield tape a second direction opposite to the first direction from the central portion of the shield tape, a second folding die configured to wrap the shield tape around at least two insulated conductors to apply a fold to the first edge of the shield tape so as to fold the first edge back over onto the central portion of the shield tape to form a receiving area, a third folding die configured to tighten the shield tape around the plurality of conductors while positioning the receiving area to receive a drain wire, a wire guide configured to install a drain wire in the receiving area, and a closing die configured to close the shield tape around the plurality of conductors and the drain wire to form an enclosure around the plurality of conductors with the second edge overlapping the receiving area at an outside surface of the enclosure.

These and other objects of the invention, as well as many of the intended advantages thereof, will become more readily apparent when reference is made to the following description, taken in conjunction with the accompanying drawings.

DETAILED DESCRIPTION OF THE INVENTION

Figure 1:
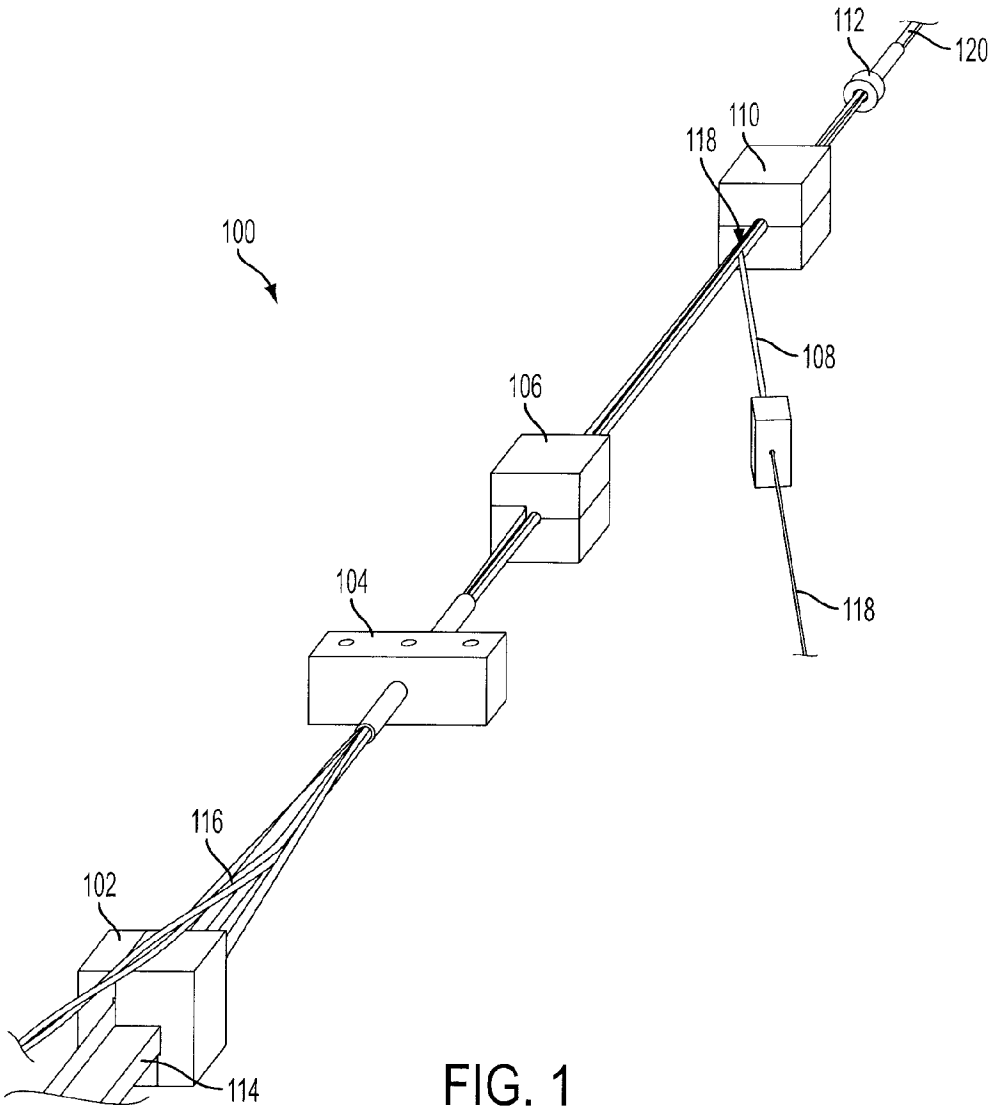
FIG. 1 is an orthogonal view illustrating a non-limiting exemplary embodiment of a shielding device according to the present invention.

Reference will now be made in detail to non-limiting embodiments of the present invention by way of reference to the accompanying drawings, wherein like reference numerals refer to like parts, components and structures.

Turning to the figures, FIG. 1 shows a cable shielding device 100 according to an embodiment of the present invention. The cable shielding device 100 may include a first folding die 102, a second folding die 104, a third folding die 106, a wire guide 108, a guide block 110, and a closing die 112. The various elements of the cable shielding device 100 operate in tandem to apply a shield tape 114 around at least two insulated conductors 116 and install an un-insulated conductor, or drain wire, 118 within a fold in the shield tape 114.

The first folding die is adapted to apply a Z-fold to the shield tape 114. The second folding die 104 is adapted to pre-form the shield tape 114 by beginning to tighten the shield tape 114 around the insulated conductors 116 and beginning to crease part of the Z-fold where the drain wire 118 is installed. The third folding die 106 is adapted to position the shield tape 114 for installation of the drain wire 118, to tighten the shield tape 114 further around the insulated conductors 116, and to maintain the orientation of the shield tape 114 so it closes properly after the drain wire 118 is installed. The wire guide 108 is adapted to install the drain wire 118 in the J-fold 306 (FIG. 3B) formed in the shield tape 114 by the first folding die 102, the second folding die 104, and the third folding die 106. The guide block 110 is adapted to maintain the shield tape 114 wrapped around the insulated conductors 116 and the drain wire 118 as they travel from the wire guide 108 to the closing die 112. The closing die 112 is adapted to close the shield tape 114 around the insulated conductors 116 and the drain wire 118 prior to jacketing the wrapped assembly 120.

Figure 2A:
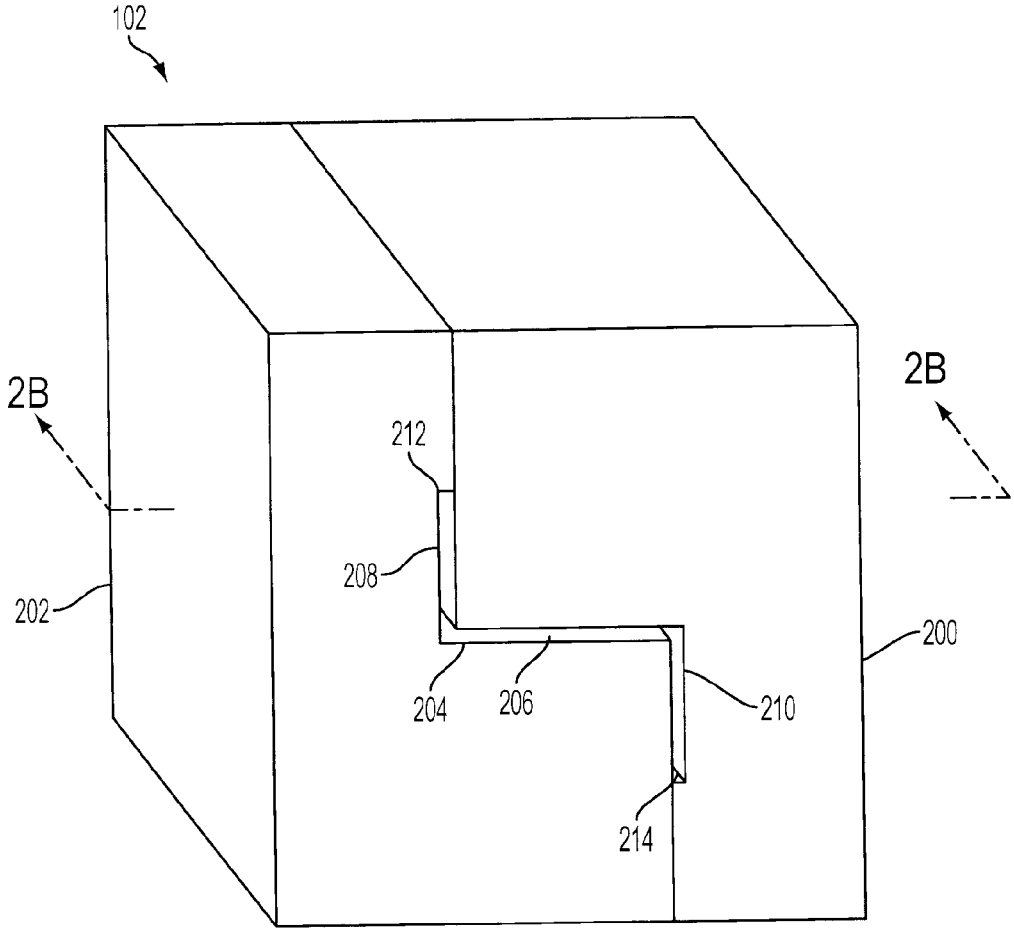
FIG. 2A is an orthogonal view illustrating a non-limiting exemplary embodiment of a first folding die of the shielding device according to the present invention.

As illustrated in FIG. 2A, the first folding die 102 includes a top portion 200 and a bottom portion 202 that are adapted to mate together and form a folding aperture 204 that extends therebetween. The folding aperture 204 includes a central portion 206, an upward folding portion 208, a downward folding portion 210, an upper lip portion 212, and a lower lip portion 214. The central portion 206 is positioned substantially in the center of the folding die 102. The upward folding portion 208 extends substantially perpendicular to the central portion 206 in an upward direction at one side of the central portion 206 and the downward folding portion 210 extends substantially perpendicular to the central portion 206 in a downward direction at the other side of the central portion 206 so that the folding aperture is formed substantially in the shape of a "Z". The upper lip portion 212 is disposed in the upward folding portion 208 and extends substantially perpendicular to the upward folding portion 208. The lower lip portion 214 is disposed in the downward folding portion 210 and extends substantially perpendicular to the downward folding portion 210.

Figure 2B:
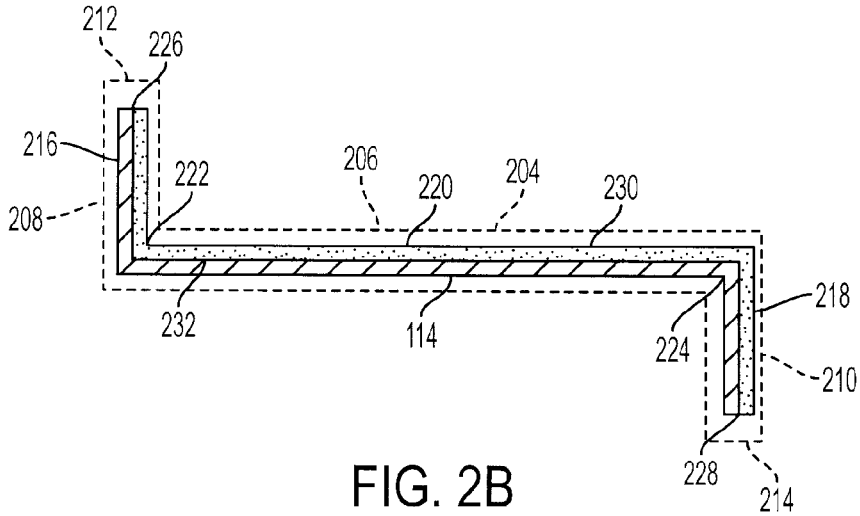
FIG. 2B is a cross-sectional view illustrating a shield tape folded by the first folding die of FIG. 2A.

As illustrated in FIG. 2B, one side of the shield tape 114 receives an upward fold 216 from the upward folding portion 208 and the other side of the shield tape 114 receives a downward fold 218 from the downward folding portion 210 when the shield tape 114 is drawn through the folding aperture 204 of the first folding die 102. The central portion 206 of the folding aperture 204 is aligned in the same plane in which the shield tape 114 is aligned as the shield tape 114 is drawn through the first folding die 102. The shield tape's central portion 220 remains in that plane as the shield tape 114 receives the upward fold 216 and the downward fold 218 from the first folding die 102. A first crease 222 is formed where the upward fold 216 extends upward from the shield tape's central portion 220 and a second crease 224 is formed where the downward fold 218 extends downward from the shield tape's central portion 220. Accordingly, the cross section of the shield tape 114 is folded in substantially the shape of a "Z" with a first edge 226 of the shield tape 114 at the top of the upward fold 216 and a second edge 228 of the shield tape 114 at the bottom of the downward fold 218, i.e., the first folding die 102 applies a "Z-fold" to the shield tape 114.

The upper lip portion 212 prevents the upward fold 216 from extending too far upward into the upward folding portion 208 by providing a physical barrier beyond which the first edge 226 of the shield tape 114 cannot extend. The lower lip portion 214 prevents the downward fold 218 from extending too far downward into the downward folding portion 210 by providing a physical barrier beyond which the second edge 228 of the shield tape 114 cannot extend. Accordingly, the upper lip portion 212 and the lower lip portion 214 work in conjunction to maintain the shield tape 114 substantially centered in the first folding die 102 as the shield tape 114 is drawn through the first folding die 102.

As also illustrated in FIG. 2B, the shield tape 114 includes an insulating layer 230 and a conductive layer 232. As the shield tape 114 is drawn through the first folding die 102, the insulating layer 230 is disposed in the upward direction, i.e., toward the top portion 200. That allows the insulated conductors 116 to be drawn over the shield tape 114 and wrapped from underneath such that the conductive layer 232 of the shield tape 114 is disposed on the outside of the wrapped assembly 120. Because the conductive layer 232 may be metallic, such as aluminum, and may come in contact with the first folding die 102 as the shield tape 114 is drawn through the first folding die 102, the first folding die 102 is formed from a low wear material, such as plastic, to prevent excessive wear from such contact and eliminate the need for pre-lubricated shield tape. The insulating layer 230 may be polyester or the like.

Figure 3A:
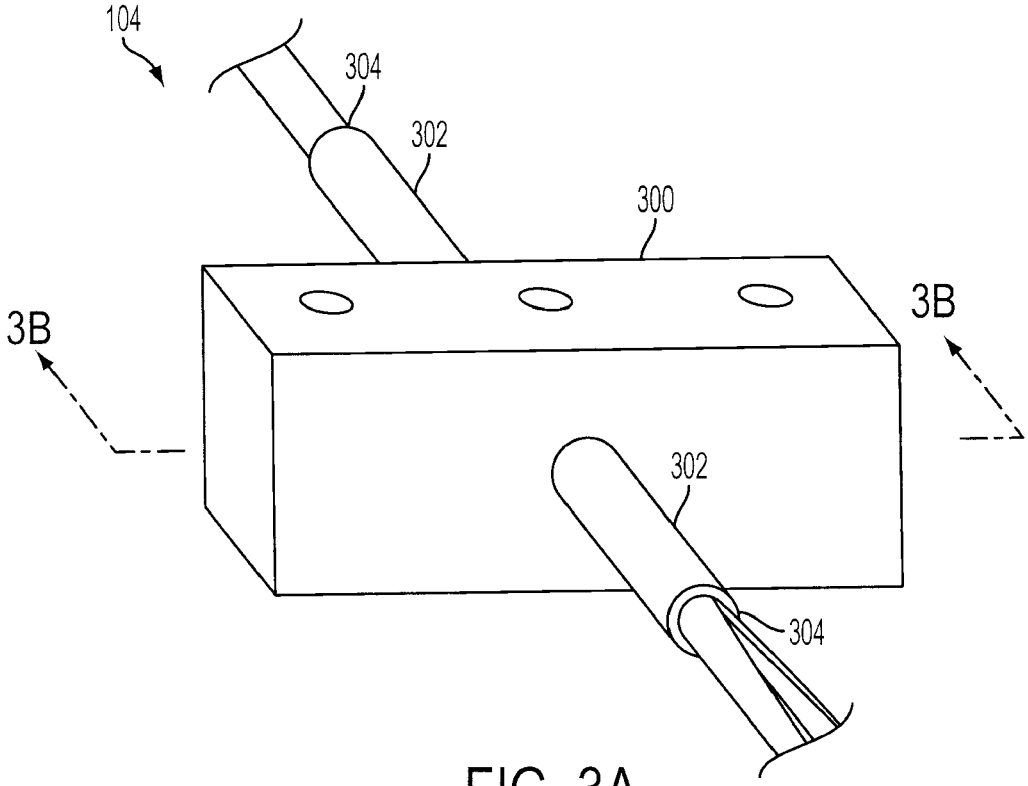
FIG. 3A is an orthogonal view illustrating a non-limiting exemplary embodiment of the second folding die of the shielding device according to the present invention.

The second folding die 104 is adapted to pre-form the shield tape 114. As illustrated in FIG. 3A, the second folding die 104 includes a stabilizing structure 300 and a pre-forming tube 302. The pre-forming tube 302 is disposed substantially in the middle of the stabilizing structure 300. The stabilizing structure 300 is adapted to maintain the pre-forming tube 302 in alignment with shield tape 114 as it is drawn through the cable shielding device 100. The pre-forming tube 302 is an elongated member with a substantially cylindrical orifice 304 extending therethough. The pre-forming tube 302 is formed from a low wear material, such as poly tubing, to prevent excessive wear from frictional contact with the conductive layer 232 of the shield tape 114.

Figure 3B:
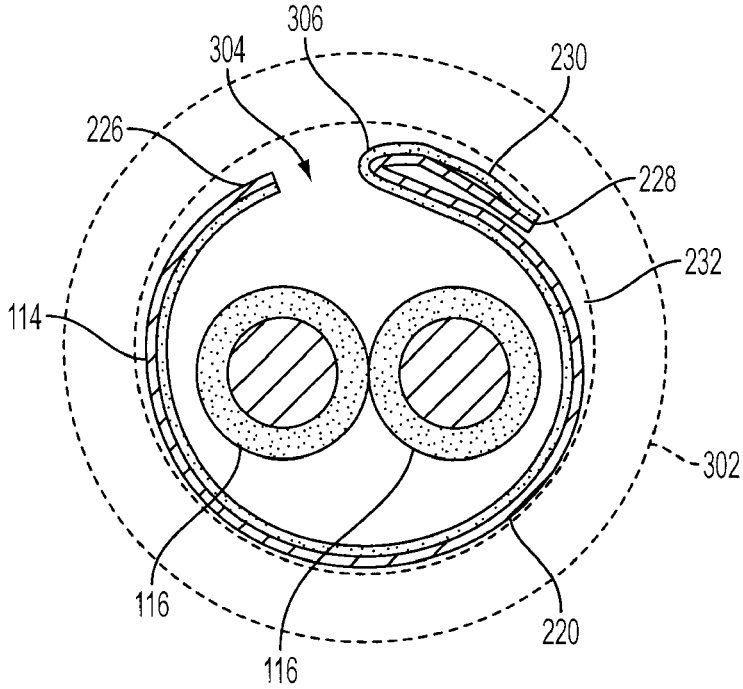
FIG. 3B is a cross-sectional view illustrating the shield tape in a die and folded around a pair of insulated conductors by the second folding die of FIG. 3A.

As illustrated in FIG. 3B, both the shield tape 114 and the insulated conductors 116 are drawn through the second folding die 104. The cylindrical orifice 304 of the pre-forming tube 302 pre-forms the shield tape 114 by causing the shield tape's central portion 220 to form an upward curve around the insulated conductors 116 and by biasing the upward fold 216 and the downward fold 218 toward the center of that curve. The curve formed by the central portion 220 is of substantially the same diameter as the circular cross section of the cylindrical orifice 304. As the circular cross section of the cylindrical orifice 304 biases the upward fold 216 toward its center, the upward fold 216 begins to align with the curve of the shield tape's central portion 220, which substantially reduces the definition of the first crease 222. And, as the circular cross section of the cylindrical orifice 304 biases the downward fold 218 toward its center, the downward fold 218 is caught between the wall of the cylindrical orifice 304 and the shield tape's central portion 220 so that the shield tape 114 becomes folded onto itself. By folding the shield tape 114 onto itself in that manner, a fold is created in the shield tape 114 substantially in the shape of a "J", i.e., the second folding die 104 applies a "J-fold" 306 to the shield tape 114, which forms a receiving area in the shield tape 114 for the drain wire 118.

Figure 4A:
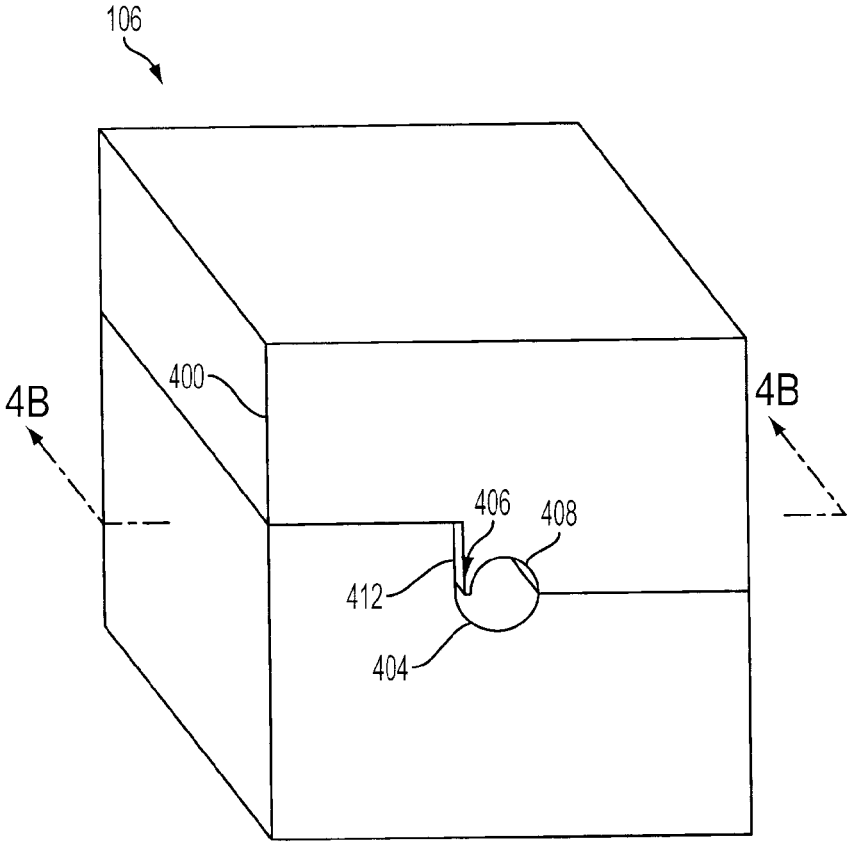
FIG. 4A is an orthogonal view illustrating a non-limiting exemplary embodiment of a third folding die of the shielding device according to the present invention.
Figure 4B:
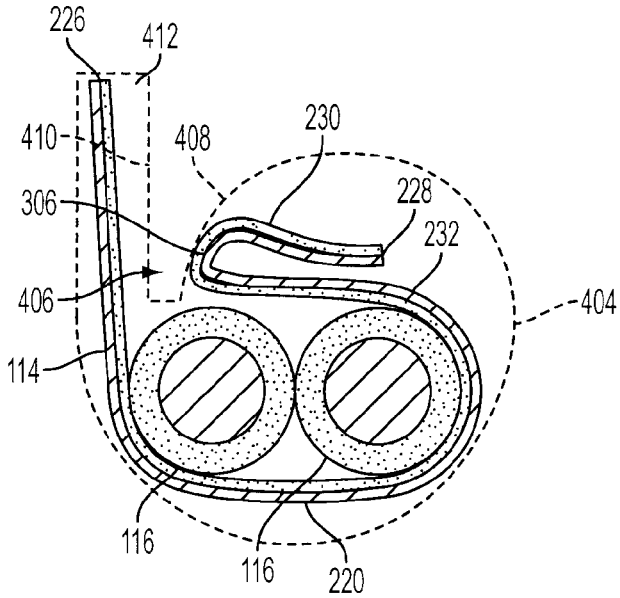
FIG. 4B is a cross-sectional view illustrating the shield tape in a die and folded around the pair of insulated conductors by the third folding die of FIG. 4A.

The third folding die 106 is adapted to position the shield tape 114 for installation of the drain wire 118 and to tighten the shield tape 114 further around the insulated conductors 116 while maintaining the orientation of the shield tape 114 so it closes properly after the drain wire 118 is installed. As illustrated in FIGS. 4A and 4B, the third folding die 106 includes a top portion 400 and a bottom portion 402 that are adapted to mate together to form a folding aperture 404 that extends therebetween. The folding aperture 404 is substantially cylindrical except that it includes a guide lip 406 protruding into a portion thereof and extending its length. The guide lip 406 includes a curved wall 408 that smoothly transitions into the cylindrical wall of the folding aperture 404 and a flat wall 410 that forms a notched out portion, or guide groove, 412 extending substantially perpendicular from the cylindrical wall of the guiding aperture 404. The third folding die 106 is preferably formed from a low wear material, such as plastic, to prevent excessive wear from frictional contact with the conductive layer 232 of the shield tape 114.

As illustrated in FIG. 4B, as the shield tape 114 is drawn through the third folding die 106 and the guiding aperture 404 tightens the shield tape 114 around the insulated conductors 116, the first edge 226 of the shield tape 114 is guided in the notched out portion 412 of the guide lip 406 and the J-fold 306 is guided by the curved wall 408 of the guide lip 406. By guiding the first edge 226 in the notched out portion 412 and guiding the J-fold 306 with the curved wall 408, the guide lip 406 positions the J-fold 306 for installation of the drain wire 118 while maintaining the proper orientation between the first edge 226 and the J-fold 306 so the first edge 226 will overlap the J-fold 306 when the shield tape 114 is closed by the closing die 112.

Figure 5A:
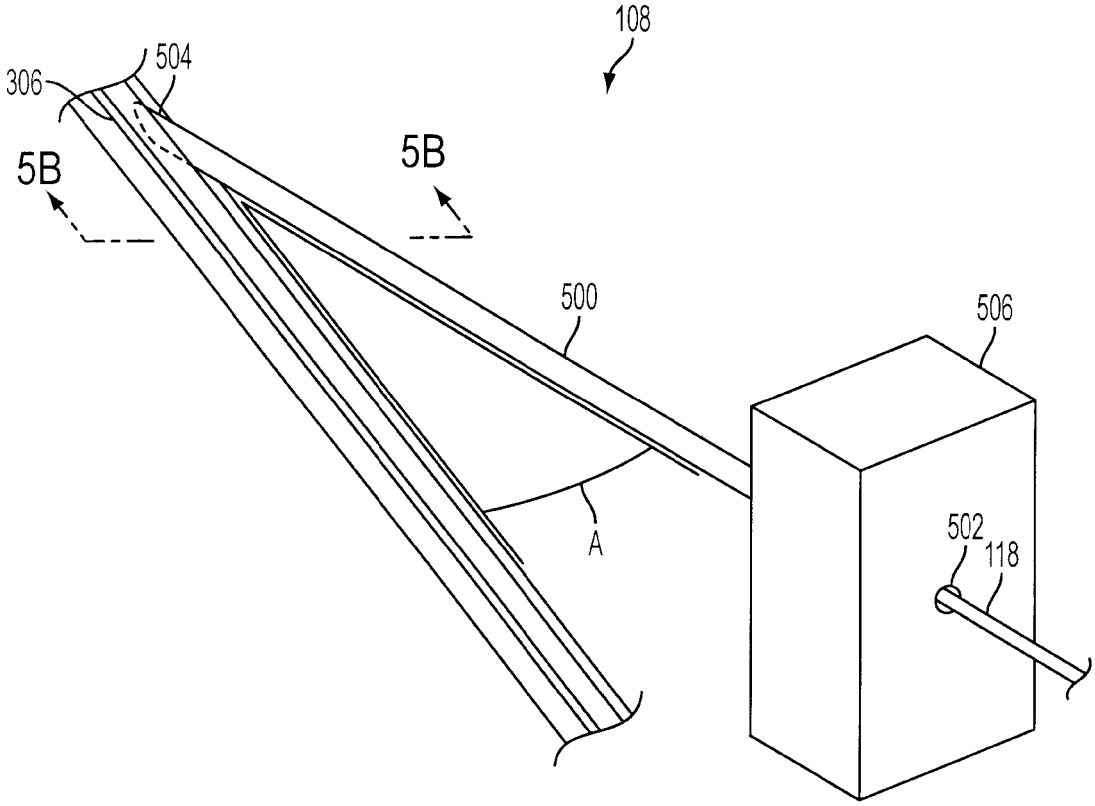
FIG. 5A is an orthogonal view illustrating a non-limiting exemplary embodiment of a wire guide of the shielding device according to the present invention.
Figure 5B:
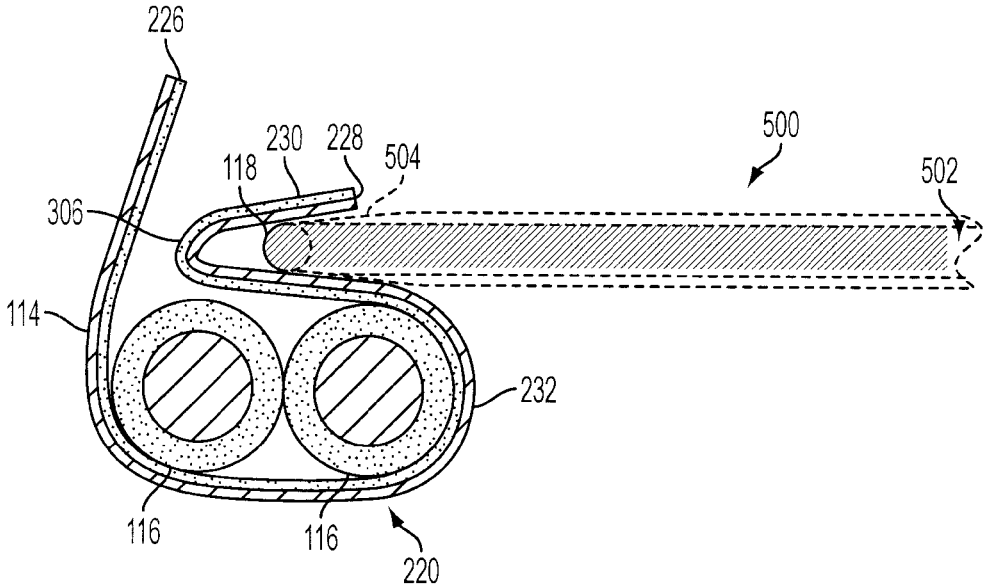
FIG. 5B is a cross-sectional view illustrating the shield tape with a drain wire installed therein by the wire guide of FIG. 5A.

The wire guide 108 is adapted to install the drain wire 118 in the J-fold 306. As illustrated in FIGS. 5A and 5B, the wire guide 108 may be in the form of a guide tube 500. The guide tube 500 includes a substantially cylindrical orifice 502 and an inserting portion 504. The cylindrical orifice 502 extends axially through the guide tube and is adapted to receive the drain wire 118 therein so that the drain wire 118 can slide therethrough as it is installed in the J-fold 306 formed in the shield tape 114. The inserting portion 504 is disposed at a distal end of the guide tube, is chamfered substantially in the shape of a "V", and is adapted to be disposed inside the J-fold 306 of the shield tape 114 where it installs the drain wire 118 as the shield tape 114 and insulated conductors 116 are drawn past the guide tube 500. The guide tube 500 may be installed on an axis at an angle "A" to the movement of the shield tape 114 and insulated conductors 116 through the cable shielding device 100. The angle "A" is preferably concave towards the direction from which the shield tape 114 and insulated conductors 116 are being drawn. The guide tube 500 may be mounted on an adjustable pivot point 506 at an end opposite the inserting portion 504 to provide for adjustment of the angle "A" at which the drain wire 118 is installed in the J-fold 306. The guide tube 500 is preferably formed from stainless steel.

Figure 6A:
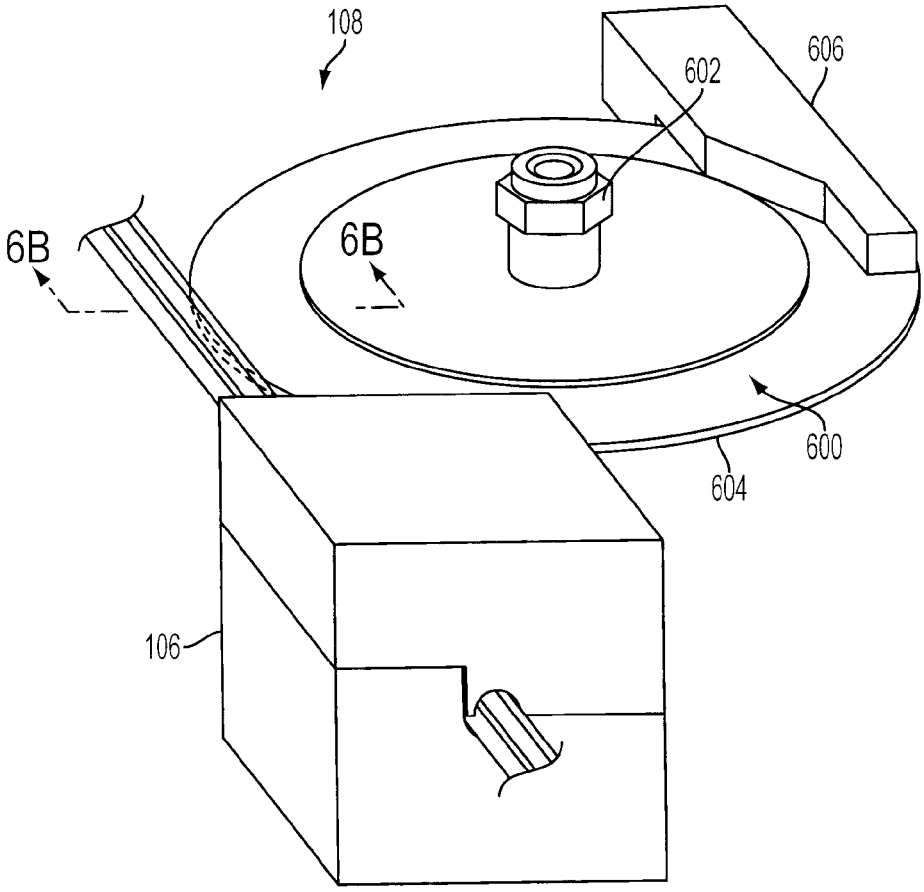
FIG. 6A is an orthogonal view illustrating a non-limiting exemplary embodiment of a wire guide of the shielding device according to the present invention.
Figure 6B:
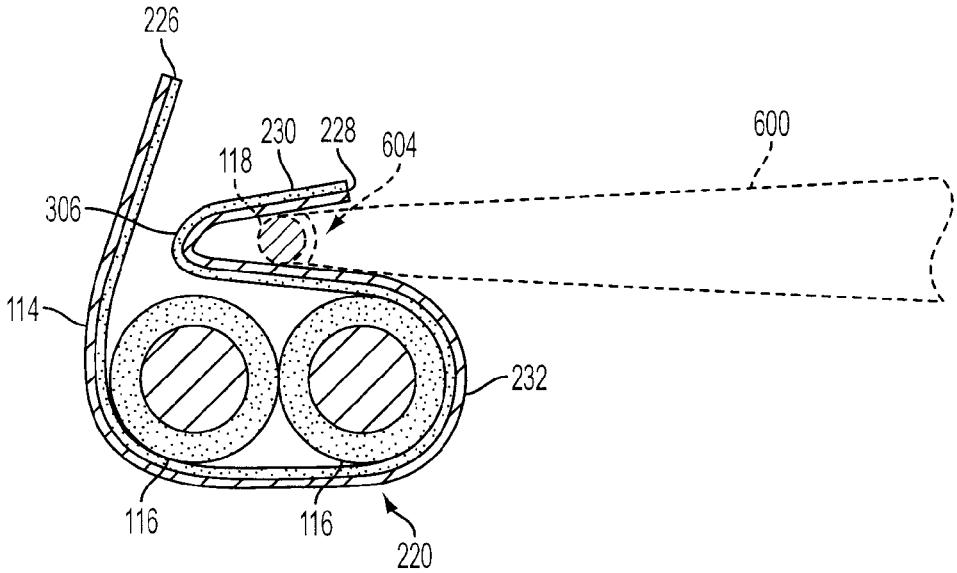
FIG. 6B is a cross-sectional view illustrating the shield tape with a drain wire installed therein by the wire guide of FIG. 6A.

In the alternative, as illustrated in FIGS. 6A and 6B, the wire guide 108 may be in the form of a guide wheel 600 that is rotatably disposed on a central axis 602 and includes a guide surface 604 disposed along the perimeter thereof. The guide surface 604 is adapted to receive the drain wire 118 therein as the drain wire 118 moves in a circular direction around the guide wheel 600. The drain wire 118 is guided into in the guide surface 604 by a guide arm 606 as the drain wire 118 is drawn through the cable shielding device 100. A distal edge of the guide wheel 600 is disposed inside the J-fold 306 of the shield tape 114 where it installs the drain wire 118 as the shield tape 114 and insulated conductors 116 are drawn past the guide wheel 600. The guide wheel 600 is preferably formed from stainless steel.

Figure 7A:
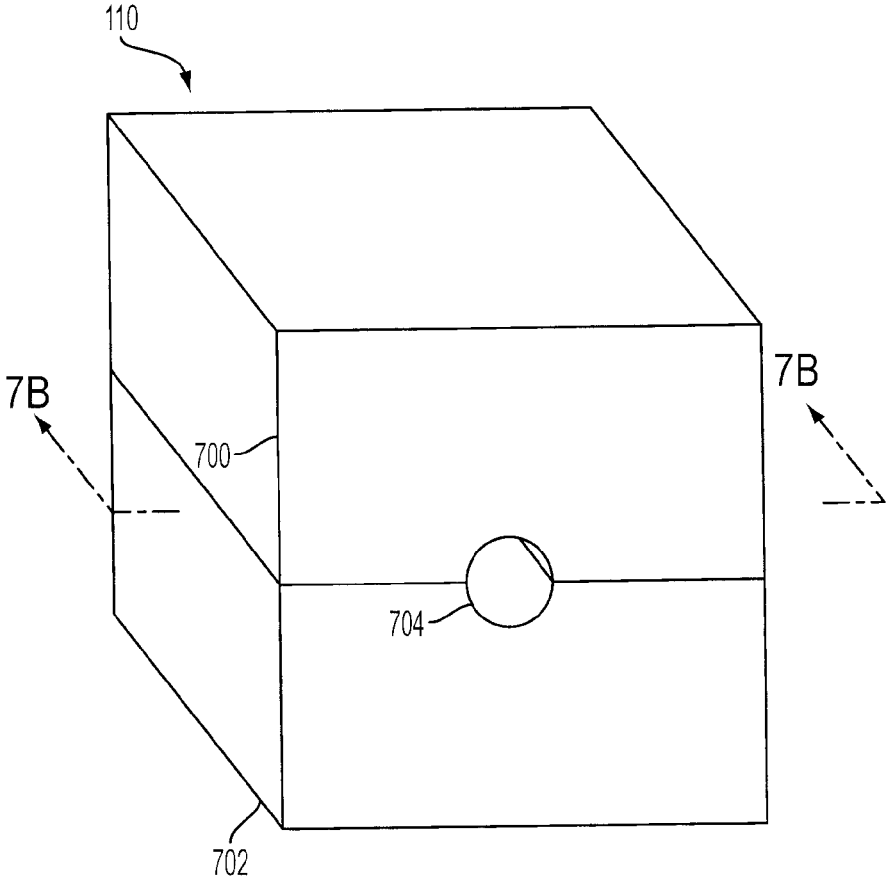
FIG. 7A is an orthogonal view illustrating a non-limiting exemplary embodiment of a guide block of the shielding device according to the present invention.

The guide block 110 is adapted to maintain the shield tape 114 wrapped around the insulated conductors 116 and the drain wire 118 as they travel from the wire guide 108 to the closing die 112. As illustrated in FIG. 7A, the guide block includes a top portion 700 and a bottom portion 702 that are adapted to mate together to form a guiding aperture 704 that extends therebetween. The guiding aperture 704 is substantially cylindrical and is of a diameter at least as small as the overall diameter of the guiding aperture 404 of the third folding die 106 so that the shield tape 114 will remain wrapped around the insulated conductors 116 and the drain wire 118 as they travel from the wire guide 108 to the closing die 112. The guiding aperture 704 may also be substantially conical with the diameter decreasing from at least as small as the overall diameter of the guiding aperture 404 of the third folding die 106 to a diameter at least as small as the tubular central portion 802 (FIG. 8) of the closing die 112 so that the shield tape 114 is progressively closed around the insulated conductors 116 and the drain wire 118 as they are drawn through the guide block 110.

Figure 7B:
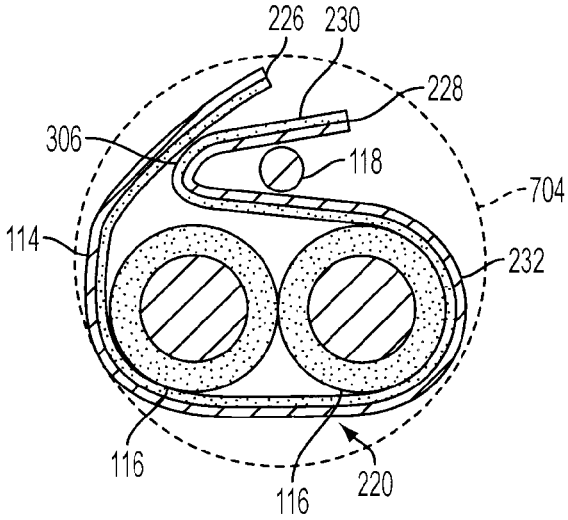
FIG. 7B is a cross-sectional view illustrating the shield tape wrapped around the pair of insulated conductors and the drain by the guide block of FIG. 7A.

As illustrated in FIG. 7B, as the shield tape 114, insulated conductors 116, and drain wire 118 are drawn through the guide block 110, the shield tape 114 at least maintains its position around the insulated conductors 116 and the drain wire 118 as was established by the third folding die 106, but preferably begins to wrap more tightly around the insulated conductors 116 and the drain wire 118. As the shield tape 114 begins to close more tightly around the insulated conductors 116 and the drain wire 118, the first edge 226 of the shield tape 114 begins to move over the J-fold 306 and the drain wire 118. Accordingly, the guide block 110 maintains the shield tape 114 wrapped around the insulated conductors 116 and the drain wire 118 as they travel from the wire guide 108 to the closing die 112. The guide block 110 may not be necessary where the closing die 112 is placed close enough to the third wire guide 108 that the drain wire 114 will not begin to open a detrimental amount when traveling from the wire guide 108 to the closing die 112.

Figure 8A:
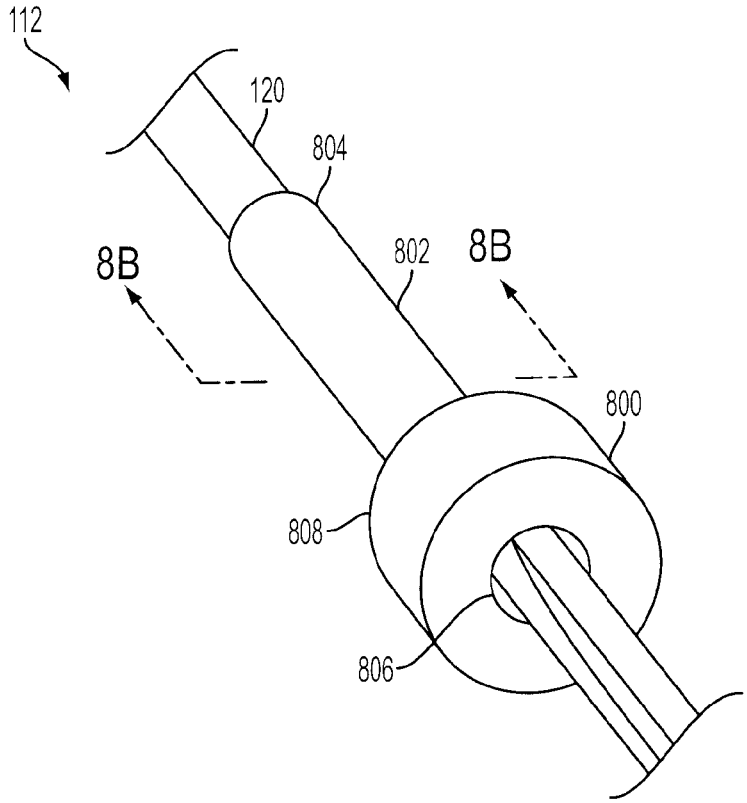
FIG. 8A is an orthogonal view illustrating a non-limiting exemplary embodiment of a closing die of the shielding device according to the present invention.

The closing die 112 is adapted to close the shield tape 114 around the insulated conductors 116 and the drain wire 118 prior to jacketing the wrapped assembly 120. As illustrated in FIG. 8A, the closing die 112 includes a receiving end 800, a tubular central portion 802, and an exiting end 804. A closing orifice 806 extends through each of the receiving end 800, tubular central portion 802, and exiting end 804 of the closing die 112. The cross section of the closing orifice 806 is sufficiently small to close the shield tape 114 down around the insulated conductors 116 and drain wire 118 as they pass through the closing die 112. Preferably, the cross section of the closing orifice 806 becomes progressively smaller as it extends from the receiving end 800 to the exiting end 804 so that the diameter of the wrapped assembly 120 is progressively compressed as the wrapped assembly 120 is drawn through the closing die 112.

The receiving end 800 of the closing die 112 is of a substantially larger diameter than the tubular central portion 802 such that a stepped portion 808 is formed at the transition between the two respective diameters. The stepped portion 808 is adapted to interface with the cross-head tip of an extruder and connect the closing die 112 thereto. The tubular central portion 802 is of a sufficient length to extend through the cross-head tip so the wrapped assembly 120 can be jacketed as it exits the exiting end of the closing die 112. The closing die 112 is preferably formed from a low wear material, such as plastic, to prevent excessive wear from frictional contact with the conductive layer 232 of the shield tape 114.

Figure 8B:
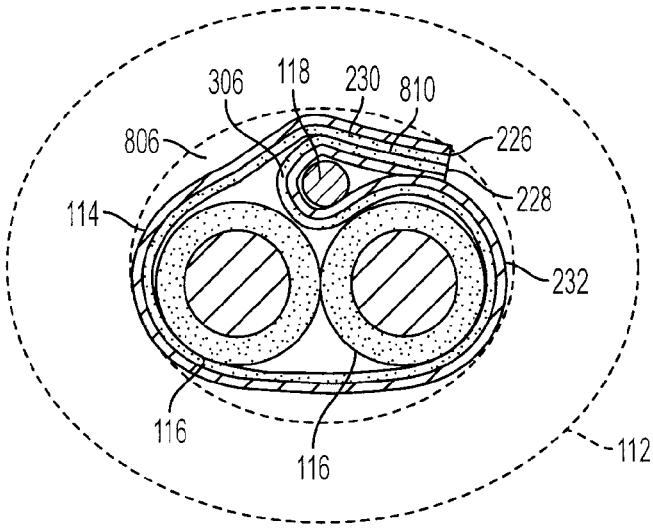
FIG. 8B is a cross-sectional view illustrating a wrapped assembly closed by the closing die of FIG. 8A.

As illustrated in FIG. 8B, as the closing die 112 closes the shield tape 114 around the insulated conductors 116 and drain wire 118, the walls of the closing orifice 806 close the J-fold 306 around the drain wire and guide the first edge 226 of the shield tape 114 over the J-fold 306 to create an overlap 810 of the shield tape 114. The wrapped assembly 120 takes on the cross-sectional shape of the closing orifice 806 as it is drawn through the closing die 112. The cross-sectional shape of the closing orifice 806 may be changed to suit the desired shape of the wrapped assembly 120.

In operation, the shield tape 114 is drawn through the first folding die 102 where it receives a "Z-fold". The width of the central portion 206 of the first folding die's 102 folding aperture 204 may be changed according to the width of the shield tape 114 to ensure the proper amount of overlap 810 of the edges 226 and 228 of the shield tape 114 when it is closed around the insulated conductors 116 by the closing die 112. For example, by centering the shield tape 114 as it passes through the first folding die 102 and sizing the central portion 206 of the folding aperture 204 to be about two thirds the width of the shield tape, a 25% overlap of the first edge 226 and the second edge 228 of the shield tape is ensured. That is because the upward fold 216 and the downward fold 218 will each be approximately one sixth the width of the shield tape's central portion 206 (⅙÷⅔=25%). By ensuring the proper amount of overlap, more efficient cable shielding is produced. Moreover, the amount of overlap can be adjusted to ensure that the first edge 226 extends beyond the second edge 228. In addition, the first edge 226 may be folded back onto the upward fold 216 and towards the second edge 228 to make contact therewith so as to maintain electrical contact between the two edges 226 and 228, which decreases leakage and further improves high frequency performance.

As the Z-folded shield tape 114 exits the first folding die 102, a plurality of insulated conductors 116 are brought into close proximity of the shield tape's central portion 206 on the side of the shield tape 114 on which the insulating layer 230 is disposed. The shield tape 114 and insulated conductors 116 then enter the second folding die 104, where the shield tape 114 is pre-formed around the insulated conductors 116 with the conductive layer 232 facing outward away from the insulated conductors 116. Because the shield tape 114 is wrapped around the insulated conductors 116 with the conductive layer 232 facing outward away from the insulated conductors 116, the shield tape 114 can be disposed between the drain wire 118 and the insulated conductors 116 so that no additional barrier layer is required between the shield tape 114 and the insulated conductors to protect them from failures, such as those measured by "hi-pot" (high potential) tests. The elimination of a need for an additional barrier layer reduces the manufacturing costs associated with shielding the insulated conductors 116.

The pre-forming tube 302 of the second folding die 104 pre-forms the shield tape 114 by folding the downward fold 218 over onto the shield tape's central portion 220 to create the J-fold 306 in which the drain wire 118 is subsequently installed. In addition to wrapping around the drain wire 118, the J-fold 306 ensures that neither the first edge 226 nor the second edge 228 of the shield tape 114 will come into electrical contact with or electrically arc with the insulated conductors 116. Because J-fold 306 folds the second edge 228 of the shield tape 114 back onto the shield tape's central portion 220, the second edge 228 is physically separated from the insulated conductors 116 by the shield tape's central portion 206, i.e., the shield tape's central portion 206 is disposed between the second edge 228 and the insulated conductors 116. And, because the first edge 226 overlaps the other side of the shield tape 114 when the closing die 112 closes the shield tape 114 around the insulated conductors 116 and drain wire 118, the first edge 226 is also physically separated from the insulated conductors 116 by the shield tape's central portion 206 when the closing die 112 closes the shield tape 114 around the insulated conductors 116. That configuration ensures that the insulated conductors 116 are surrounded only by the insulating layer 230 of the shield tape 114, which greatly reduces the risk of hi-pot test failures.

The pre-forming tube 302 of the second folding die 104 also pre-forms the shield tape 114 by beginning to remove the first crease 222. As the second folding die 104 begins to curve the shield tape's central portion 220 around the insulated conductors 116, the shield tape's central portion 220 begins to move into the same plane as the upward fold 216 at the first crease 222. Although the definition of the first crease 222 is substantially reduced by the second folding die 104, the internal stresses imparted on the shield tape 114 at the first crease 222 when it was Z-folded by the first folding die 102 act to prevent the first edge 226 from folding over onto the insulated conductors 116 prematurely so that the J-fold 306 can be folded under the first edge 226 by the closing die 112 after the drain wire 118 is installed therein.

After the pre-formed shield tape 114 and partially wrapped insulated conductors 116 exit the second folding die, they enter the folding aperture 404 of the third folding die 106. The folding aperture 404 of the third folding die 106 further tightens the shield tape 114 around the insulated conductors 116. While further tightening the shield tape 114 around the insulated conductors 116, the guide lip 406 of the third folding die 106 positions the J-fold 306 for installation of the drain wire 118 while maintaining the proper orientation between the first edge 226 and the J-fold 306 so that the first edge 226 will overlap the J-fold 306 when the shield tape 114 is closed by the closing die 112.

After the third folding die 106 further closes the shield tape 114 around the insulated conductors 116 and properly positions the J-fold 306, the wire guide 108 installs the drain wire 118 in the J-fold 306 as the shield tape 114 and insulated conductors 116 are drawn past the wire guide 108. The drain wire 118 is drawn through the cable shielding device 100 with the shield tape 114 and insulated conductors 116. When the drain wire 118 is installed in the J-fold 306, it is disposed between the conductive layer 232 of the downward fold 218 and the conductive layer 232 of the shield tape's central portion 220. By surrounding the drain wire 118 with conductive material in this manner, the drain wire 118 makes better electrical contact with the shield tape 114 than conventional drain wires that are merely installed between the shield tape and an insulating layer, such as the cable jacket.

With the drain wire 118 installed in the J-fold 306, the shield tape 114, the insulated conductors 116, and the drain wire 118 are all drawn through the guide block 110, which maintains the shield tape 114 wrapped around the insulated conductors 116 and the drain wire 118 as they travel from the wire guide 108 to the closing die 112. As the shield tape 114, insulated conductors 116, and drain wire 118 are drawn through the closing die 112, the shield tape 114 is closed around the insulated conductors 116 and the drain wire 118. And, because the guide block 110 may have a guiding aperture 704 that is substantially conical with a diameter that decreases to at least as small as the diameter of the closing orifice 806, much or all of the closing of the shield tape can be performed by the guide block 110 prior to the shield tape 114, insulated conductors 116, and drain wire 118 entering the closing die 112. As the shield tape 114 is closed around the insulated conductors 116 and the drain wire 118, a smooth transition is created over the drain wire 118 when the first edge 226 of the shield tape 114 is moved over to overlap the J-fold 306. The smooth transition of shield tape 114 over the drain wire 118 substantially removes any ridge that would otherwise be created on the wrapped assembly 120 if the drain wire 118 were disposed on the opposite side of the shield tape 114 from the insulated conductors 116. By removing the ridge from the outside of the wrapped assembly 120, problems with jacketing and installation can be eliminated.

The closing die 112 can be inserted directly to an extruder cross-head so that the wrapped assembly 120 is jacketed as it exits the closing die 112. As the extruder jackets the wrapped assembly 120, a rip cord (not shown) can be installed between the wrapped shield tape 114 and the jacketing so that the jacketing can more easily be removed from the wrapped assembly 120 in the field. Alternatively, a rip cord may be installed between the insulated conductors 116 and the shield tape 114.

Accordingly, the cable shielding device 100 of the present invention can be utilized in tandem with an extruder and other cabling equipment, such as an inside-out cabler, in a continuous process. And, because the cable shielding device 100 is able to wrap shielding on insulated conductors that have already been cabled/stranded, it can be installed between a cabling/stranding machine and an extruder, thereby reducing what would otherwise be a two-step process into a one-step process. Thus, the present invention allows a single operator to complete an entire cabling/stranding, shielding and jacketing process without having to place cabled/stranded conductors on a reel and pay them back off through the shielding device 100 and/or an extruder.

The foregoing description and drawings should be considered as illustrative only of the principles of the invention. The invention may be configured in a variety of shapes and sizes and is not intended to be limited by the preferred embodiment. Numerous applications of the invention will readily occur to those skilled in the art. Therefore, it is not desired to limit the invention to the specific examples disclosed or the exact construction and operation shown and described. Rather, all suitable modifications and equivalents may be resorted to, falling within the scope of the invention. For example, although the shield tape 114 preferably includes an insulating layer 230 and a conductive layer 232, the shield tape 114 may be only a single layer that is either dielectric or conductive; or, alternatively, the shield tape 114 may be more than two layers of insulating and conductive material in any suitable arrangement.

What is claimed is:

1. A method for applying a shield tape to a plurality of insulated conductors, the shield tape including a conductive layer and an insulating layer, comprising the steps of:

folding a first edge of the shield tape in a first direction from a central portion of the shield tape while folding a second edge of the shield tape in a second direction opposite the first direction from the central portion of the shield tape;

applying a fold to the first edge of the shield tape by folding the first edge back over onto the central portion to form a receiving area while wrapping the shield tape around the plurality of conductors;

tightening the shield tape around the plurality of conductors such that the conductive layer of the shield tape is on the outside of the insulating layer and facing away from the conductors while positioning the receiving area to receive a drain wire;

installing a drain wire in the receiving area; and closing the shield tape around the plurality of conductors and the drain wire to form an enclosure around the plurality of conductors with the second edge overlapping the fold at an outside surface of the enclosure.

2. The method for applying a shield tape according to claim 1, wherein the shield tape includes a conductive layer that faces outward away from the plurality of conductors when the shield tape is wrapped around the plurality of conductors.

3. The method for applying a shield tape according to claim 2, wherein the step of wrapping the shield tape around the plurality of conductors includes drawing the plurality of conductors over the shield tape and wrapping the shield tape around the plurality of conductors from underneath with the conductive layer of the shield tape facing away from the plurality of conductors.

4. The method for applying a shield tape according to claim 1, wherein the second edge overlaps the folded first edge by an amount substantially equal to at least 25% of a width of the shield tape when the shield tape is closed around the plurality of conductors and the drain wire.

5. The method for applying a shield tape according to claim 1, further comprising the step of applying a jacketing layer around the enclosure.

6. The method for applying a shield tape according to claim 5, further comprising the step of installing a rip cord between the jacketing layer and the shield tape.

7. The method for applying a shield tape according to claim 1, further comprising the step of installing a rip cord between the shield tape and the at least two insulated conductors.

8. The method for applying a shield tape according to claim 1, further comprising the step of cabling/stranding the at least two insulated conductors prior to wrapping the shield tape around the at least two insulated conductors.

9. The method for applying a shield tape according to claim 1, wherein the step of folding the first edge of the shield tape in the first direction and the second edge of the shield tape in the second direction results in the shield tape being folded in substantially the shape of a "Z".

10. The method for applying a shield tape according to claim 1, wherein the step of folding the first edge of the shield tape in the first direction and the step of folding the second edge of the shield tape in the second includes folding the first edge and the second edge at locations on the shield tape that are approximately one sixth of the shield tape's unfolded width from the first edge and the second edge, respectively.

11. The method for applying a shield tape according to claim 1, wherein the step of wrapping the shield tape around the plurality of conductors includes drawing the plurality of conductors over the shield tape and wrapping the shield tape around the plurality of conductors from underneath with the conductive layer of the shield tape facing away from the plurality of conductors.

12. The method for applying a shield tape according to claim 1, wherein the step of wrapping the shield tape around the plurality of conductors at least partially unfolds the second edge of the shield tape from the second direction.

13. The method for applying a shield tape according to claim 1, wherein the step of folding the first edge back over onto the central portion to form a receiving area creates a fold in the shield tape that is substantially in the shape of a "J".

14. The method for applying a shield tape according to claim 13, wherein the step of positioning the receiving area to receive a drain wire includes positioning the first edge above the fold in the shield tape that is substantially in the shape of a "J" so the first edge will overlap the fold in the shield tape that is substantially in the shape of a "J" during the step of closing the shield tape around the plurality of conductors and the drain wire.

15. The method for applying a shield tape according to claim 13, wherein the receiving area is defined by the fold in the shield tape that is substantially in the shape of a "J"; and the step of installing the drain wire in the receiving area includes installing the drain wire in a curved portion of the "J".

16. The method for applying a shield tape according to claim 13, wherein the step of closing the shield tape around the plurality of conductors and the drain wire includes closing the fold in the shield tape that is substantially in the shape of a "J" around the drain wire and guiding the first edge of the shield tape over the fold in the shield tape that is substantially in the shape of a "J" so as to create an overlap of the shield tape.

17. The method for applying a shield tape according to claim 16, wherein the second edge overlaps the fold in the shield tape that is substantially in the shape of a "J" by an amount substantially equal to at least 25% of a width of the shield tape.

18. The method for applying a shield tape according to claim 1, further comprising the step of tightening the shield tape around the plurality of conductors and the drain wire after the step of installing the drain wire in the receiving area and before the step of closing the shield tape around the plurality of conductors and the drain wire.

19. The method for applying a shield tape according to claim 1, wherein the shield tape includes a conductive layer that faces outward away from the plurality of conductors when the shield tape is wrapped around the plurality of conductors; and the step of installing a drain wire in the receiving area includes substantially surrounding the drain wire with the shield tape so that the conductive layer faces inward toward the drain wire.

20. The method for applying a shield tape according to claim 1, wherein the step of closing the shield tape around the plurality of conductors and the drain wire forms an enclosure with a smooth transition where the drain wire is disposed.

21. The method for applying a shield tape according to claim 1, wherein the first edge and second edge of the shield tape are positioned at the outside surface of the enclosure when the shield tape is closed around the plurality of conductors and the drain wire.

* * * * *